United States Patent [19]

Kane

[11] Patent Number: 4,772,878

[45] Date of Patent: Sep. 20, 1988

[54] MERCHANDISE THEFT DETERRENT SENSOR

[76] Inventor: Roger A. Kane, 4098 Rainwood Ave., Yorba Linda, Calif. 92686

[21] Appl. No.: 46,470

[22] Filed: May 6, 1987

[51] Int. Cl.[4] ..... G08B 13/14

[52] U.S. Cl. ..... 340/568; 340/665

[58] Field of Search ..... 340/568, 571, 572, 665, 340/668; 200/159 B, 83 N, 85 R, 86 R

[56] References Cited

U.S. PATENT DOCUMENTS

| | | | |
|---|---|---|---|
| 3,879,593 | 4/1975 | Larson | 200/83 NX |
| 4,006,336 | 2/1977 | Boyden | 340/568 X |
| 4,440,999 | 4/1984 | Doughty | 200/159 BX |
| 4,602,135 | 7/1986 | Phalen | 200/86 R X |
| 4,649,397 | 3/1987 | Heaton et al. | 340/572 X |
| 4,694,283 | 3/1987 | Reeb | 340/572 |

*Primary Examiner*—Glen R. Swann, III

*Attorney, Agent, or Firm*—Harland L. Burge, Jr.

[57] ABSTRACT

The Merchandise Theft Deterrent Sensor deters theft of display merchandise by implementation of a sensor directly into an anti theft detection system. The Merchandise Theft Deterrent Sensor is attached directly to goods through the use of a pair of specially designed adhesive surfaces; one surface in the form of a peripheral rectangular window surrounds as second surface which is directly attached to a centrally located, moveable piston and electrical membrane switch assembly. The piston membrane switch assembly activates an alarm means if motion on the order of two thousandths of an inch occurs. The Merchandise Theft Deterrent Sensor is assembled in a small rectangular molded plastic container, wherein the closeout lid of the container is flexible to enable in-place checkout of the sensor by minor depression of the lid to activate the moveable piston and electrical membrane switch assembly. Any number of the Merchandise Theft Deterrent Sensors can be connected in series to provide protection against theft of multiple pieces of merchandise.

14 Claims, 5 Drawing Sheets

MERCHANDISE THEFT DETERRENT SENSOR

BACKGROUND OF THE INVENTION

1. Field of the Invention

This invention relates to providing a sensor to provide deterrence against the theft of display merchandise and particularly to a sensor which can be integrated into an overall anti-theft detection system.

2. Description of the Prior Art

Hard goods thievery of items such as computers, television sets, typewriters, microwaves, and refrigerators, as examples is an increasing problem that every merchandise business runs into. Such hard goods can range from small easily portable goods to the heavier goods, such as refrigerators. In order to promote sales to the buying public, the merchandise must be displayed and as is the case with computers and typewriters, the display must also be such that the buying public can actually handle the items. Those items such as television sets, radios, video tape recorders, video cameras, cameras, computers, hand held electronic entertainment devices, and so forth, are particularly susceptible to thievery. A number of concepts have been designed and formulated to provide means to minimize thievery of such items. Examples of such are found in U.S. Pat. Nos. 4,069,919, to Fernbaugh, 3,905,103 to Fernbaugh, 3,972,039 to Marshal, 3,596,265 to Garland, 3,253,270 to Downer, 2,913,712 to Lee, 3,127,597 to Lewin, and 4,000,588 to Ephraim. Are as yet non-patented concept design to be applied in such applications is also represented by U.S. application Ser. No. 06/401,630 by Kane. Each of these concepts has been suggested for use in the commercial applications area and the latter Kane concept has been used extensively in major department stores in the United States.

The Fernbaugh system utilizes a flexible cable with a single electrical conductor in such cable and the cable is passed through soft goods or hard goods to provide protection against thievery. The Fernbaugh concept requires such flexible cables to be connected into an interlocking method, wherein the flexible cable is locked in place and its electrical circuit completed. This system is inflexible in that the merchandise must remain close to the locking cable member. Furthermore, the circuit in the flexible cable member can be fooled by the use of jumper pans and clamps allowing the flexible member to be severed to remove the merchandise without triggering an associated alarm means. A more sophisticated system and apparatus is represented by the Marshal system, which employs a three wire alarm system cabling network, in conjunction with a mechanically actuated switching sensor that is placed on the hard goods to be protected. The Marshal system provides an alarm signal if the employed cabling is disconnected, or if the hard goods sensor is removed from the hard goods, thereby activating a switching circuit in the alarm means. The three wire Marshal system virtually eliminates the ability of the thief to accurately and instantaneously jumper the circuit in such a way that the alarm is not set off. The Marshal system hard goods sensor can be fooled by slipping a knife or other thin object under the hard goods sensor and thereby maintain the switch in the sensor in the activated position. A disturbance in the Marshal system would therefore go undetected. The Garland patent concept utilizes various flexible loops with two conductors in the flexible loop and a mechanical means at the end of the loops to secure the loops to the merchandise, which is to be protected against theft. The loops are plugged into a centralized alarm system. The Garland concept requires the merchandise to be within the length of any of the loops, which are connected to the plug in means for the alarm system, and as such the Garland system is not extendable away from the alarm system. Many items of merchandise therefore require many different loops.

The Downer patent similarly requires a single loop for each item of merchandise as does the Garland patent.

The Lee patent utilizes a single conductor and does allow for extending such a conductor to many pieces of merchandise; however, the Lee patent is susceptible to the use of circuit jumpers, which allow the conductor to be broken by the thief, without setting off associated alarm circuits.

The Cohen patent utilizes a pre-cut adhesively bonded thin film foil for use on glass entry ways to foil the entry of burgulars into business establishments. This thin film foil by itself cannot be practically used on most merchandise to prevent thievery.

The Lewin, et al., patent was developed to provide protection against thievery of electrical devices such as tools and household appliances. The Lewin alarm system is dependant upon an actual withdraw of a power cord plug from a specially designed plug socket, which is internally triggered to signal that a theft is occurring.

In the Ephraim patent a three way flexible cable is connected to a flexible label patch, which contains an etched or printed circuit on the patch, which in turn is adhesively pressed onto the merchandise to be protected. The actual sensing element contains the etched or printed circuit and is destructable and must be replaced after being removed or torn from the merchandise. An examination of the Ephraim circuit reveals that such circuit can be jumpered to provide apparent circuit continuity, and thus allow thievery to take place of the goods to be removed.

The present invention provides protection from tampering with the cables by the use of a two circuit sheath cable and center conductor, which is connected to the sensor itself. Any attempted tampering of the two circuit; sheath cable and center conductor, triggers a suitable alarm means as does any tampering with the sensor itself. As a result the two circuit; sheath cable and center conductor becomes an integral part of the sensor. The sensor concept of the present invention is easily extendable to numerous items of merchandise by simple extension of the use of the two circuit; sheath cable and center conductor. The present invention utilizes no thin film foils such as the Cohen patent teaches or that art taught in the Kane application, nor does the present application require any specially designed plug sockets for signaling that a theft is occurring, such as required by the Lewin patent. When compared to the Ephraim patent, the present invention is found to provide a totally rearmable and reuseable sensor concept. As such, the present application provides a device which is able to provide display merchandise security with a flexibility for broad use. The present invention also provides an inexpensive capital outline and a simplicity which lends itself to ease of installment and maintenance by store personnel. It has been found that if such simplicity is not present, that store personnel simply will not continue to use an anti-theft system to prevent thievery. Public display of merchandise is important to overall sales and the present concept allows the customer public to examine merchandise. Any anti-theft sensor system must not be susceptible to false alarm, since this will also aggrevate both store personnel and the buying public. The present invention provides a very simple means of resetting, should inadvertant alarming occur. And most importantly, the present invention provides a most positive alarm signal means in a manner desired by the business management. The present merchandise theft deterrent sensor also provides a means for being expandable or contractable to many or few items of merchandise and as such has no limitations on the number of items that can be protected.

SUMMARY OF THE INVENTION

The Merchandise Theft Deterrent Sensor is generally comprised of a small rectangular plastic enclosure box, which contains a specially designed membrane switch; the membrane switch is adhesively connected to the interior of the enclosure box which has a moveable piston assembly, which provides the actuation for the membrane switch. The moveable piston and the membrane switch are designed to provide for signal actuation, if the merchandise theft deterrent sensor is tampered with in any way. The actuation signal occurs when the moveable piston is disturbed by no more than three thousandths of an inch of motion on the overall merchandise theft deterrent sensor. The merchandise theft deterrent sensor rectangular plastic enclosure also contains an electrical lead connection to the membrane switch and the electrical lead connection is carried out electrically to connect to specially designed two circuit shielded conductors, which also form a part of the overall merchandise theft deterrent sensor. In addition to the small motion aspect for detecting possible thievery the rectangular plastic enclosure utilizes a flexible plastic covering cap closure, which enables the use of thumb pressure to test and/or activate the merchandise theft deterrent sensor and allow the merchandise theft deterrent sensor to remain in place, while such test and/or activation is conducted. The merchandise theft deterrent sensor is fastened to hard goods through the use of adhesives, which connect to the merchandise theft deterrent sensor and also provide an adhesive surface to attach to the goods to be protected. The adhesive surfaces are made up in two parts, an overall picture window adhesive component provides peripheral adhesive attachment between the merchandse theft deterrent sensor rectangular plastic box and the goods to be protected. A separate circular adhesive attaches to the moveable piston and also to the goods to be protected. This dual adhesive concept provides protection in that if a thief attempts to use a thin cutting edge to slide under the sensor to prevent activation of the overall merchandise theft sensor, the mere lifting of the peripheral adhesive surface still leaves the circular moveable piston adhesive surface intact, and the small two to three thousandths of an inch motion causes the interior membrane switch to activate and generate a signal to a central alarm means. The merchandise theft deterrent sensor is adaptable to a number of different alarm means, which are suitable for detecting and relaying or providing signals that a theft attempt is under way. The merchandise theft deterrent sensor provides an expandable or contractable protection means, in that the merchandise theft deterrent sensors can be serially interlocked together, they can be used singularly, and there are no limitations to the number of pieces of merchandise which can be protected by the merchandise theft deterrent sensor concept.

The hard goods mounted theft deterrent sensor is rearmable also in the event that an attempted theft occurs or if the merchandise theft deterrent sensor is moved from one set of goods to another set of goods. The rearming occurs by replacing the mounting adhesive surfaces referred to earlier and when the merchandise theft deterrent sensor is placed upon the surface of the hard goods to be protected, the merchandise theft deterrent sensor is automatically ready for its next service.

The circuitry for the rearmable merchandise theft deterrent sensor is designed for series flow, direct or alternating electrical current, and dual circuit flexible shielded center conductor wire cables are utilized for this purpose. The center wire of the cables provides the primary circuit for the overall circuit. The cable connections into the rectangular plastic box are interconnected and potted in such a manner that the cables cannot be readily pulled out of the merchandise theft deterrent sensor. The cables further serve an anti-theft purpose, in that if a thief attempts to cut the cables, a signal is generated to a suitable alarm means. Further any attempted shorting of the conductors automatically generates a signal to a suitable alarm means.

The membrane switch assembly is made up of three picture frame circuits, two of which are connected to the ground portion of the circuit and the middle picture frame provides the floating potential part of the circuit. The picture frame circuits are photo screened on a suitable plastic base and when assembled will activate when a two to three thousandths of an inch motion occurs to cause the circuit to close.

BRIEF DESCRIPTION OF THE DRAWINGS

The advantages and features of the novelty of the merchandise theft deterrent sensor concept will become more apparent as the description proceeds, in conjunction with the accompanying drawings, in which.

PREFERRED EMBODIMENT

My invention with its preferred embodiment will become more clearly understood in this description.

Figure 1:
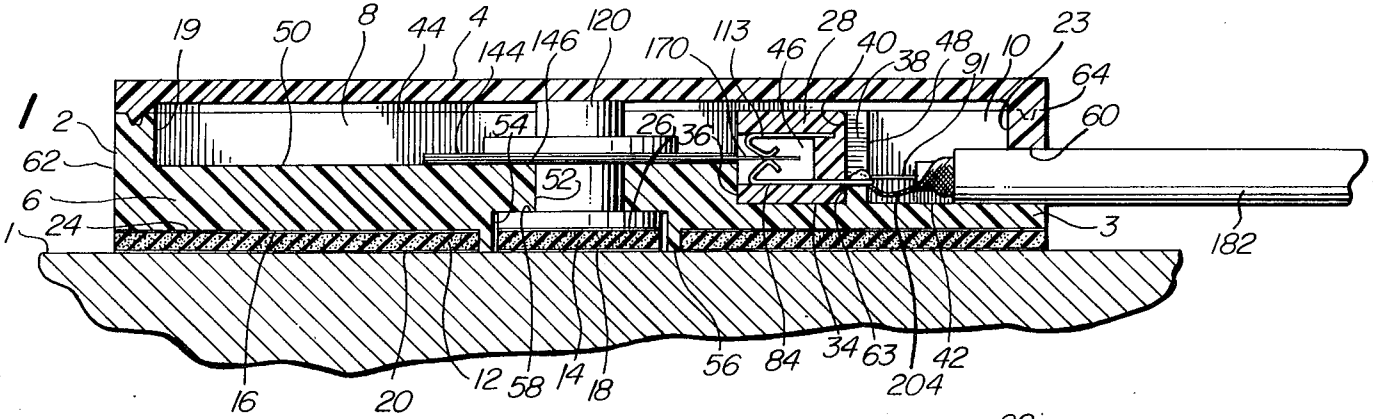
FIG. 1 is a cross-sectional view of the merchandise theft deterrent sensor attached onto a hard goods surface, indicating, for illustration purposes the overall plastic rectangular box enclosure together with the centrally located moveable piston assembly and membrane switch assembly, the electrical leads from the membrane switch, and the two conductor sheathed cable leading out of the plastic rectangular box enclosure; the picture frame peripheral adhesive surface is shown connected to the rectangular plastic box and also to the indicated hard goods surface, while the moveable piston is shown with a circular adhesive made of the same adhesive material, which is connected to both the moveable piston surface and the hard goods surface, with the circular adhesive being separated from the picture window peripheral adhesive.

FIG. 1 shows a cross-section of the merchandise theft deterrent sensor 2 which is housed in a plastic rectangular box enclosure container made up of a lid 4 and a lower half 3. Within the theft deterrent sensor 2 are contained a centrally located moveable piston assembly 120, a membrane switch assembly 144, membrane switch electrical lead 170 being shown, a plug-in receptacle unit 28 to receive the membrane switch electrical leads and showing lead 170 in the plug-in receptacle unit, electrical connection 91 and 204 to the plug-in receptacle unit from a two conductor sheathed cable 182, one of two such cables entering the merchandise theft deterrent sensor 2. Attached to the merchandise theft deterrent sensor box 2 is a picture frame peripheral adhesive 12 with an adhesive side 16 forming a bond on the surface, and adhesive side 20 forming a bond on the symbolic hard goods 1. The merchandise theft deterrent sensor box 2 is enclosed by the lid 4, the end 62, the end 64, the lower surface 24 and surfaces 5 and 7 (shown in FIG. 2). Within the merchandise theft deterrent sensor box 2 are cavities 8 and 10, wherein cavity 8 contains the centrally located moveable piston assembly 120, and cavity 10 contains the two conductor sheathed cable electrical levels 91, 204 (and 89, 87, 93, and 210, 208, 206, 204 from FIG. 14). The cavity 10 is potted with a suitable potting material upon final assembly. The membrane switch assembly 144 is held in place in cavity 8 by an adhesive surface 146 between the membrane switch assembly 144 and surface 50. The cavity 8 in FIG. 1 is formed by surfaces 50, 19, 43 (shown in FIG. 3), and surface 53 from FIG. 4, and with surfaces 43 and 45 (from FIG. 2) and the plug-in receptacle unit 28 from FIG. 1. The centrally located moveable piston assembly 120 is centered in circular apertures 52 and 54. A circular adhesive 14 is bonded to the centrally located moveable piston assembly 120 by surface 26 and this circular adhesive 14 is further bonded in the symbolic hard goods 1 by surface 18. The centrally located moveable piston 120 is further restrained from excessive movement in application by surface 58. A circular protruding tab 56 provides an isolating surface between the picture frame peripheral adhesive 12 and the circular adhesive 14. Within the lower half 3 of the plastic rectangular box enclosure, the plug in receptacle unit 28 is further restrained by surface 36.

Figure 6:
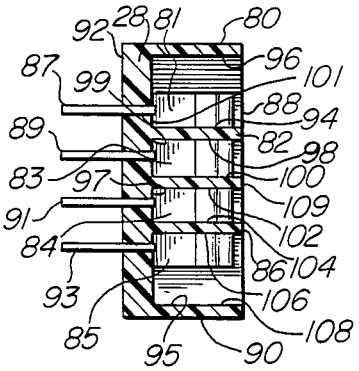
FIG. 6 shows a cross-section of the plug in receptical unit which receives the conductors from the membrane switch and which also shows the leads to the two conductor cables.
Figure 7:
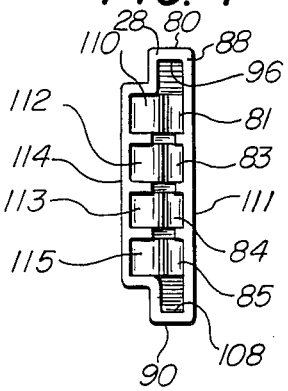
FIG. 7 is an "end"-view of the receptical portion of the receptical shown in FIG. 6.

Shown for illustration purposes within the plug-in receptacle unit are electrical conductors 113 and 84, which are located in cavity 46. (There are four identical sets of such conductors as shown in FIGS. 6 and 7.) Electrical conductors 113 and 84 are spring tension electrodes to provide intimate contact with electrical lead 170 from the membrane switch assembly 144. Surfaces 34, 63 and 40 provide additional restraining surfaces to hold the plug-in receptacle unit 28 in place. Electrode 84 is soldered to ground conductor 204 for illustration purposes in FIG. 1. Cavity 10 is formed by surfaces 48, 42, 23 in FIG. 1 and sufaces 25, 49, 22 and 21 from FIG. 2. A rectangular aperture 38 allows for passing electrical conductors such as 84. Line 44 shows the parting surface between the lid 4 and the lower half 3 of the plastic rectangular box enclosure. Two conductor sheathed cables 182 and 184 (from FIG. 14) pass through rectangular aperture 60.

Figure 2:
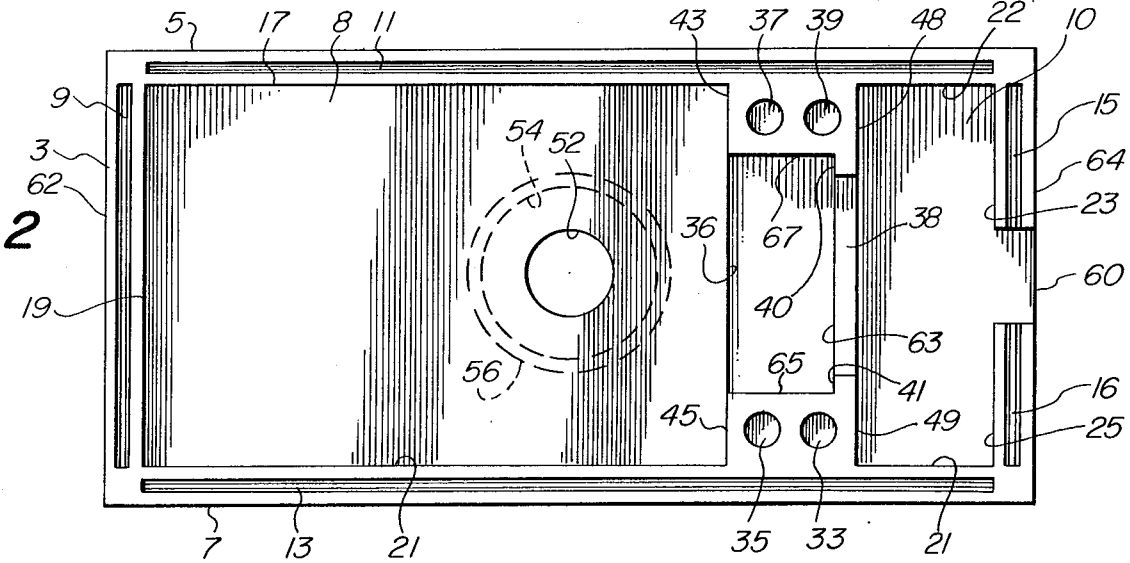
FIG. 2 is a top view of the lower part of the rectangular plastic structure which contains the membrane switch and the moveable piston and the view shows the centrally located aperture through which the moveable piston is allowed to move, as well as the location of the electrical innerconnect plug which receives the leads from the membrane switch and the potting location for the two conductor cables.

FIG. 2 is a top view of the lower half 3 of the merchandise theft deterrent sensor 2, containing cavity 8 and cavity 10, wherein cavity 8 is further defined by interior surfaces 19, 17, 21, 43, and 45. The extremity surfaces are shown by surfaces 7, 62, 5, 64. The restraining surfaces 36, 65, 67, 40, 41, 63 for the plug-in receptacle unit 28 are illustrated. Cavity 10 is enclosed by surface 49, 48, 21, 22, 23, 25 apertures 33, 35, 37, 39 serve as mold control points for the lower half 3; without these apertures to help keep the housing flat where the plastic mold cools the thicker plastic would cool slower thus causing warping of the lower half 3. The rectangular aperture 38 provides access from cavity 10 to the plug-in receptacle unit 28 (FIG. 1). Within the edges formed by surfaces 19, 62 is a small V-groove 9, similarly surfaces 5 and 17 enclose an edge with V-groove 11, surfaces 7, 21 enclose an edge ith V-groove 13, surfaces 23 and 64 enclose an edge with V-groove 15, surfaces 25 and 64 enclose an edge with V-groove 16. Circular aperture 52 is centrally located in the lower half 3 and is concentric with circular aperture 54 formed by tab 56.

Figure 3:
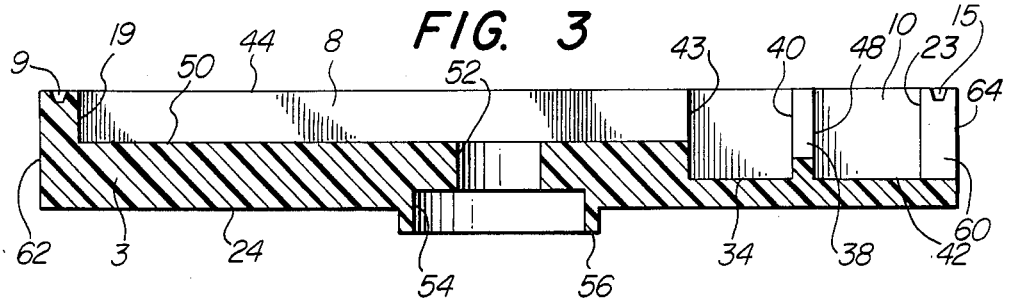
FIG. 3 is a cross-sectional view of the lower part of the rectangular plastic enclosure and the figure indicates additional detail as to where the moveable piston is located and also shows a separation circular ledge to provide the peripheral picture window adhesive limits as compared to the location of the adhesive circular element which attaches to the moveable piston.

FIG. 3 further illustrates the lower half 3 of the merchandise theft deterrent sensor 2 by use of a cross-section view and removal of the interior components shown in FIG. 1. The end surfaces 62, 64 are illustrated, along with the parting line 44 between the lower half 3 and the lid 4 (FIG. 1). Cavity 8 and cavity 10 are shown, and cavity 10 is contained interior to surfaces 48, 42, 23 and line 44, while cavity 8 is contained interior to surfaces 19, 50, 43 and line 44. Apertures 38 and 60 are illustrated with access to cavity 8. The surfaces 43, 40 and 34 restrain the plug-in receptacle unit 28. The central aperture 52 is located directly in the middle of the lower half 3 and is concentric with circular aperture 54 and circular tab 56. Surface 24 receives the adhesive surface 16 (from FIG. 1).

V-grooves 9 and 15 are shown in the cross-section.

Figure 4:
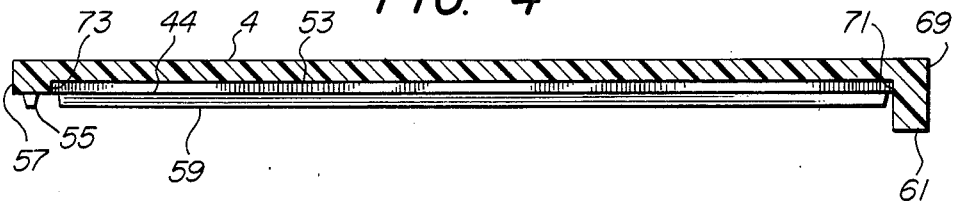
FIG. 4 shows a cross-section of the lid which is attached on the top of the rectangular plastic lower half structure and indicates also attachment structure which fits into the grooves on the lower half of the plastic structure.

FIG. 4 is a cross-section of the lid 4 with end surfaces 57, 69 and interior surfaces 73, 53, 71 as shown. The thickness of the lid 4 is selected to provide a flexible and easily depressed surface directly over the centrally located moveable piston assembly 120 of FIG. 1. As shown line 44 provides the connecting line between the lid 4 and the lower half 3. The V-protrusion 55 mates and matches into V-groove 9 of FIG. 2 and V-protrusion 59 mates and matches into V-groove 11 (FIG. 2). Tab 61 is a protrusion which serves to close the upper surface of aperture 60.

Figure 5:
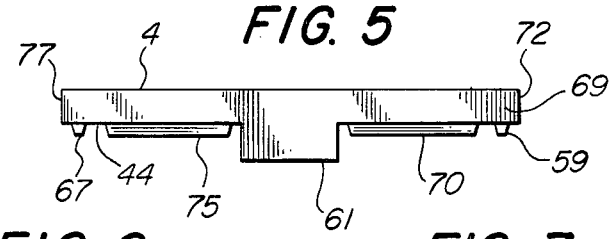
FIG. 5 is an "end"-view of the FIG. 4 element showing structure which provides for attaching the lid to the lower half of the plastic rectangular structure and also showing a tab which is used to cover any possible access to the interior of the enclosure.

FIG. 5 is an end view of the lid 4 with surfaces 77, 72 and showing line 44, the surface between lid 4 and lower half 3, along with showing the view of surface 69. V-protrusion 67 which mates and matches to V-groove 13 (from FIG. 2) and V-protrusion 59 which mates and matches to V-groove 11 (FIG. 2) are illustrated as are V-protrusions 75 and 70 which mate and match to V-grooves 16 and 15, respectively. Tab 61, as illustrated, protrudes to form the upper surface of rectangular aperture 60 (from FIG. 1).

FIG. 6 as a cross-sectional view of the plug-in receptacle unit 28, reveals from identical spring electrodes 81, 83, 84, 85 connected to identical electrical leads 87, 89, 91, 93. The four identical spring electrodes 81, 83, 84, 85 are compartmentalized and separated by wall 82 formed by surface 94 and surface 98, wall 109 formed by surface 100 and 102, wall 86 formed by surface 104 and surface 106. All electrical interior elements are maintained in a plastic enclosure defined by external surfaces 92, 80, 88, 90 and internal surfaces 101, 99, 97, 95, 108, 96.

FIG. 7 is an end view of the FIG. 6 plug-in receptacle unit 28. In the FIG. 6 end view the spring electrodes 85, 84, 83, 81 are shown with mating spring electrodes 115, 113, 112, and 110 respectively. Surface 114 is the top of the plug-in receptacle unit 28 and surface 111 is the bottom of the plug-in receptacle unit 28. For clarity, surfaces 80, 96 and 90, 108 are shown to illustrate the end close out of the plug-in receptacle unit.

Figure 8:
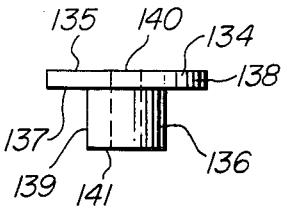
FIG. 8 is a side view of the cylindrical bottom part of the moveable piston and also indicating a small centrally located hole through which the top half of the cylindrical piston is attached through means of a central shaft.

FIG. 8 is a side view of the bottom part of the centrally located moveable piston assembly 120 (shown in FIG. 10) which is comprised of a cylindrical cylinder 139 which is integral and coincident with a second cylindrical cylinder 134. A cylindrical aperture 140 pierces the bottom part 136. The second cylindrical cylinder 134 is of larger diameter than is cylindrical cylinder 139 and is defined by parallel surfaces 135, 137, and circular surface 138, and further the distance between surfaces 135 and 137 is only a fraction of the distance between surface 137 and 141.

Figure 9:
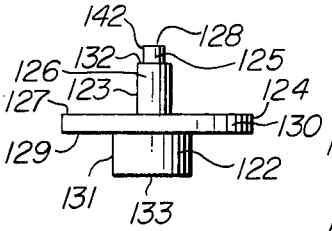
FIG. 9 is a side view of the other half of the cylindrical moveable piston and shows the shaft which is inserted into the centrally located cylindrical aperture of FIG. 8.

The FIG. 9 side view shows the top part 122 of the centrally located moveable piston assembly 120 which is comprised of four right cylinders 131, 130, 126 and 125, all with coincident axis. Right cylinder 122 is further defined by parallel surfaces 133, 129, and circular surface 122, right cylinder 130 is defined by parallel surfaces 127, 129 and circular surface 124, right cylinder 126 is defined by parallel surfaces 127, 132 and circular surface 123, and right cylinder 125 is defined by parallel surfaces 128, 132 and circular surface 142.

Figure 10:
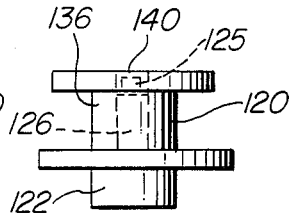
FIG. 10 is an assembly of the FIG. 8 and FIG. 9 parts which comprise the moveable piston.

FIG. 10 is the assembly of the centrally located moveable piston assembly with the bottom part 136 mated to the top part 122, and showing right cylinders 126 and 125 in place, noting that cylinder 125 is smaller than the aperture 140, whereas right cylinder 126 is a tight fit in aperture 140.

Figure 11:
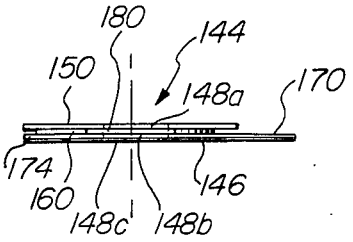
FIG. 11 is a side view in part cross-sectional of the membrane switch assembly, indicating three parts to the membrane switch.
Figure 12:
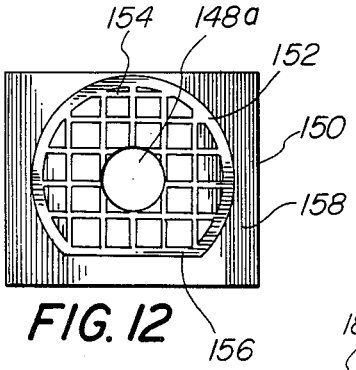
FIG. 12 is the top part of the membrane switch and shows the photo screened conductor surface on the plastic base; also indicated is a central aperture through which the moveable piston assembly passes.

The membrane switch is described in FIGS. 11, 12, and 13. FIG. 11 shows the membrane switch assembly 144 (from FIG. 1, and as shown the membrane switch assembly 144 consists of three layers of plastic, 150, 160, and 174 with an adhesive surface 146 attached to the bottom side of the lower plastic layer 174. Electrical leads issue from the membrane switch assembly and are symbolically indicated by lead 170. The three plastic layers 150, 160, 174 and the adhesive surface 146 are defined by apertures 148*a, b, c*. The center layer 160 is defined by aperture 148*b* which is larger in diameter than apertures 148*a* and *c*.

The underside of plastic layer 150 provides a shielding electrical conductor network (FIG. 13*b*) photo screened onto the plastic layer 174. As shown, the circuit on the plastic layer 174 provides an electrical shielding network 178 which is diagonal and terminates into a linear buss 179 with two electrical photo deposited leads 175, 177. The central aperture 148*b* is sized to allow the right cylinder 136 to fit through the aperture 148*b* with a few thousandths of an inch clearance.

Figure 13A:
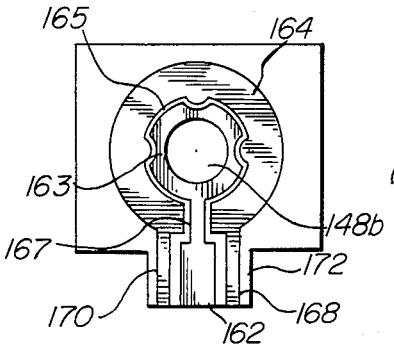
FIG. 13*a* shows the floating potential part of the membrane switch which is the centrally located element of the membrane switch. Also shown is the ground potential part of the circuit which is the external part of the conductor; the central part of the conducting surface provides the floating potential surface and the centrally located aperture provides the means whereby the moveable piston passes. through the membrane switch.
Figure 13B:
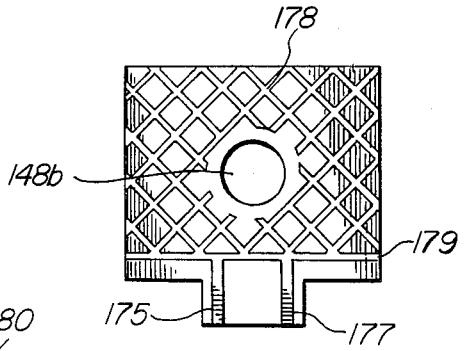
FIG. 13*b* shows the underside of the element of the membrane switch and the leads which are also electrically connected to the ground leads of FIG. 13*a;* the electrical circuit is photo screened on a plastic base and the central aperture provides a means whereby the moveable piston of FIG. 10 is inserted through the membrane switch.

On the upper surface of the plastic layer 174, is photo deposited the electrical circuit network shown in FIG. 13*a*, such electrical circuit network consisting of electrical leads 168, 170 connected to a mostly circular element 164 and an electrical lead 162 connected to a smaller and mostly circular element 163 which is concentrically located within circular element 164. Aperture 148*b* defined by the center of element 163. Electrical element 163 is separated from electrical element 164 by a space 165 of a few thousandths of an inch. Electrical leads 170 and 168 are also of identical sizing and spacing as the electrical leads 175, 177 of FIG. 13*b*.

FIG. 12 shows a photo deposited electrical circuit 152, 154, and 156 on the underside of the upper plastic layer 150 with the aperture 148*a* in the center of the plastic layer. The circuits shown in FIGS. 12 and 13*a* are photoscreened onto separate film layer, with an insulative layer 160 in between, electrical circuit 152 is in the form of a partial circle and continues to a linear circuit 156. Within the circuit 152 and 156 is a rectangular circuit 154. Electrical circuits 152, 154, and 156 are placed on the under surface of the plastic layer 150 and rests against the upper surface of the plastic layer 160. The aperture 148*a* is sized to enable the right cylinder 139 to pass through with a few thousandths of an inch clearance.

Figure 13C:
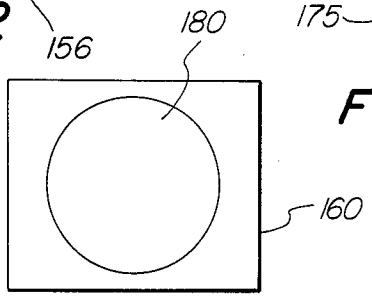
FIG. 13*c* shows the center element of the membrance switch with an aperture that enables the FIG. 12 circuit to contact the circuits of FIG. 13*a*.

FIG. 13*c* is a view of the plastic insulating layer 160 which has no electrical circuits on it and has an aperture 180 with a diameter larger then apertures 148*a* and *c* but slightly smaller than the diameter of electrical circuit member 152 of FIG. 12.

The membrane switch assembly 144 activates when the electrical circuit on membrane 150 is depressed through aperature 180 located in plastic layer 160 and contacts the electric circuit elements on the surface of plastic layer 174. As indicated, electrical circuits 178, 179 serve as a shielding network on the membrane switch assembly 144 to prevent stray electrical signals from possibly activating the selected alarm means to which the membrane switch is electrically connected. Such depression causes electrical continuity to occur between circuits 163 and 164, causing a suitable signal to trigger an alarm means when said alarm is in the alarm mode.

To further understand the activation of the membrane switch assembly 144 (shown in FIGS. 1 and 11), the membrane switch assembly is adhesively bonded to the interior of the merchandise theft deterrent sensor 2 on surface 50 (FIG. 1) and the centrally located moveable piston assembly 120 comprised of the lower part 122 and upper part 136 is assembled into place with right cylinder 139 protruding through the membrane switch assembly apertures 148*a, b*, and *c*, and 180 to receive the upper part 136 wherein surface 127 is pressed down onto surface 141 and a binding chemical solvent is deposited into aperture 140 to fill in over right cylinder 125.

Figure 14:
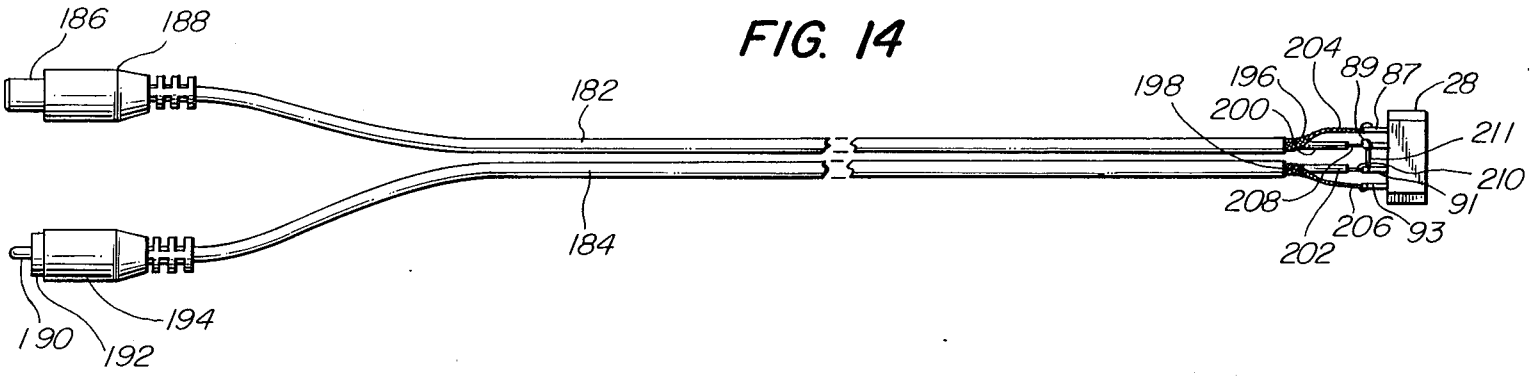
FIG. 14 shows the male and female two conductor cable elements connected to the interior receiving receptical of the merchandise theft deterrent sensor; the two conductor circuit is also exposed for clarity.

The two conductor sheathed cables 182, 184 electrically connected to the plug-in receptacle unit 28 are shown in FIG. 14. A female two conductor cable 182 is created with a female 186 conductor in connector 188 and a male two conductor cable 184 is created with a male 190 conductor in a connector 194. The connectors 188 and 194 contain grounding provisions 192 and grounding sheaths 196, 198 which are formed into leads 204, 206. The grounding sheath 196, 198 are electrically isolated from central conductors 208, 210 by insulation sleeves 200, 202. The grounding leads 204, 206 are connected into leads 87, 93 from the plug-in receptacle unit 28. The two center leads 89 91 are electrically tied when lead 162 is inserted into the receptacle 28, and the grounding sheaths are electrically tied when leads 170, 168, 175, and 177 (FIGS. 13*a* and *b*), are inserted into the receptacle 28.

Figure 15:
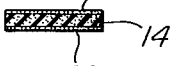
FIG. 15 is a cross-sectional view of the circular adhesive patch which connects to the moveable piston showing the protective non-adhesive surfaces in place.

The circular adhesive 14 with adhesive surfaces 26 and 22 is shown in FIG. 15. Adhesive surface 26 attaches to surface 135 of the centrally located moveable piston assembly 120 lower part 139 (as illustrated in FIG. 1), while adhesive surface 22 attaches to the symbolic hard goods 1, (as illustrated in FIG. 1).

Figure 17:
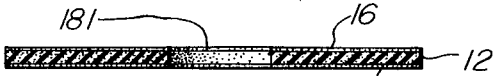
FIG. 17 is a cross-sectional view of the picture window peripheral adhesive assembly which also shows the non-adhesive protective surfaces in place prior to the picture window peripheral adhesive being applied to the plastic rectangular structure of the merchandise theft deterrent sensor.

The picture frame peripheral adhesive 12 is shown in FIG. 17 with adhesive surfaces 16, 20 and aperture 212. Adhesive surface 16 attaches to surface 24 of the body of the merchandise theft deterrent sensor 2, while adhesive service 20 attaches to the symbolic hard goods 1 (as illustrated in FIG. 1) aperture 212 encircles circular tab 56 as shown in FIG. 1.

Figure 16:
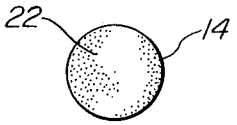
FIG. 16 is a surface view of the circular and cylindrical adhesive patch that makes up the adhesive which attaches to the moveable piston assembly.

FIG. 16 is a plane view of the circular adhesive 14, looking at adhesive surface 22.

Figure 18:
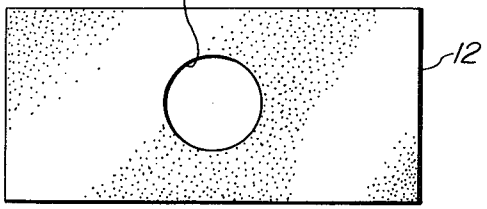
FIG. 18 is a surface view of the FIG. 17 adhesive showing a central aperture through which the moveable piston and FIG. 16 circular patch protrudes.

The plane view of the picture frame peripheral adhesive 12 is shown in FIG. 18, along with the aperture 212.

Figure 19:
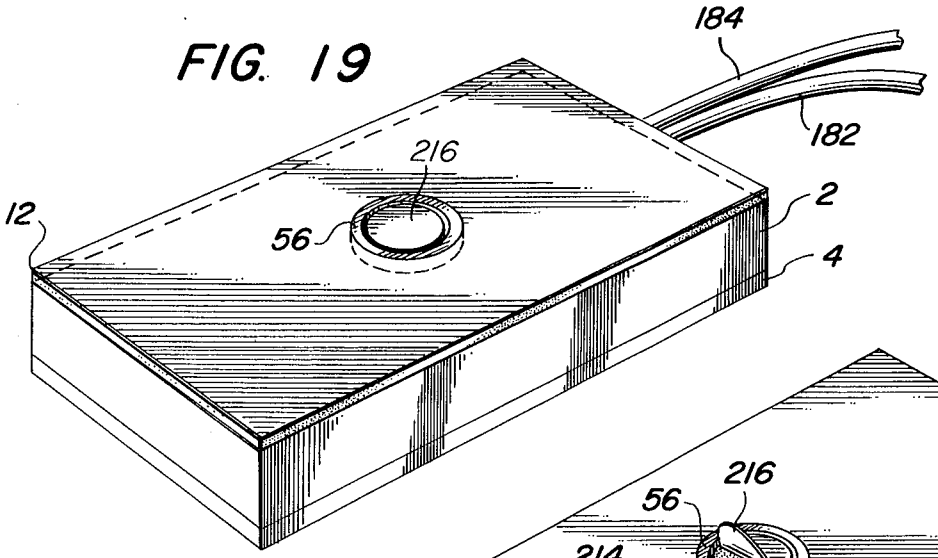
FIG. 19 is an isometric view of the merchandise theft deterrent sensor with the adhesive peripheral window and the circular central adhesive in place and the surface non-adhesive protective surfaces in place.

The merchandise theft deterrent sensor 2 is shown in isometric form in FIG. 19, with the two conductor sheathed cables 182, 184, and the circular adhesive 14 and picture frame peripheral adhesive 12 in place, but with protective surface 216 and 214 in place; the isolating circular divider tab 56 is also shown as is the lid 4.

Figure 20:
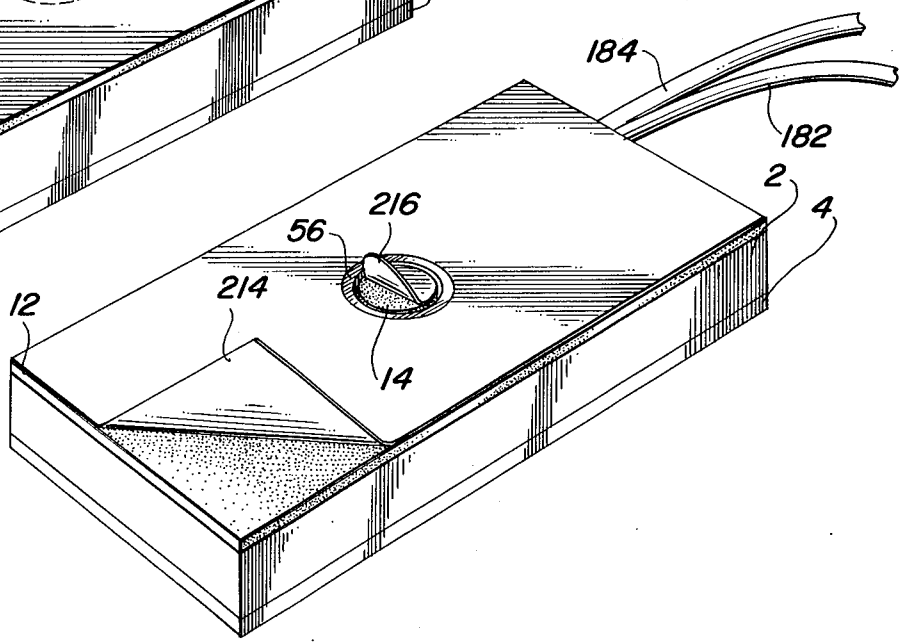
FIG. 20 is an isometric of the merchandise theft deterrent sensor indicating the non-adhesive surfaces being removed in preparation for placing the merchandise theft deterrent sensor on the hard goods to be protected.

The preparation of the merchandise theft deterrent sensor for application to a hard goods surface is illustrated isometrically in FIG. 20 where the protection surfaces 214 and 216 are being peeled away.

Assembly of the merchandise theft deterrent sensor is accomplished in the following steps: (1) the two conductor cables 182, 184 are electrically connected to the plug-in receptacle 28 with ground sheath connections 206, 204 to electrical leads 87, 93 and center conductor 208, 210 connections to electrical leads 89, 91; (2) the plug-in receptacle unit 28 is placed in the lower half 3 of the plastic rectangular enclosure box of the merchandise theft deterrent sensor within the space defined by surfaces 36, 67, 40, 63, 41, and 65 (FIG. 2) with the electrical leads 87, 89, 91, 93 (FIG. 6) protruding into cavity 10; (FIG. 1) (3) the membrane switch assembly 144 is plugged into the plug-in electrical receptacle with its adhesive 146 side facing down onto the surface 50 and with apertures 148*a* and *c*, and 180 centered over aperture 52, and with electrical leads 170, 168, 175, 177 connected into spring electrodes 81, 110, 85, 115 and with electrical lead 162 connected into spring electrodes 83, 112, 84, 113; (4) the adhesive 146 is pressed into surface 50 to complete the installation of the membrane switch assembly 144; (5) the lower part 139 of the centrally located moveable piston assembly 120 is inserted into apertures 52, 54 with right cylinder 134 pressed against surface 58; (6) the upper part 122 of the centrally located moveable piston assembly 120 is inserted into the lower part 139 to the extent that right cylinder 130 rests against the top plastic layer 150 surface; (7) chemical solvent bonding agent is added to aperture 140 of the lower part 139 of the centrally located moveable piston assembly 120 until the aperture is full and level with surface 135; (8) cavity 10 is filled with a suitable potting compound until the potting compound is level with line 44; (9) V-grooves 9, 11, 13, 15, 16 are coated with a chemical solvent; (10) the lid 4 is inserted such that mating V-protrusions 55, 59, 67, 70, 75 match into V-grooves 9, 11, 13, 15, 16 respectively; (11) picture frame peripheral adhesive 12 is placed on surface 16 and circular adhesive 14 is placed on surface 135.

In application, protective surfaces 214, 216 are removed and the merchandise theft deterrent sensor 2 is pressed onto the symbolic hard goods 1 such that adhesive surfaces 20, 18 adhere to the hard goods 1. The two conductor cables 182, 184 are connected to a suitable alarm means which provides voltage potential between ground and the center conductors 208, 210. Any member of merchandise anti-theft sensor(s) 2 may be connected in series, and connectors 182, 184 are designed to enable length extension from one hard goods sample to another. The merchandise theft deterrent sensor 2 is system checked when in place by finger or thumb pressure on the lid 4 which depresses the centrally located moveable piston assembly 120 a few thousandths of an inch and activates the membrane switch assembly 144, causing the alarm means to signal, when the alarm means is in the test mode. Such few thousandths of an inch movement is made possible by use of an elastic adhesive as the primary material of the circular adhesive 14.

The merchandise theft deterrent sensor deters theft in several ways, when the alarm means is in the active mode: (1) Any movement of the merchandise theft deterrent sensor with respect to the hard goods 1 causes the centrally located moveable piston assembly 120 to move and activate the membrane switch 144; (2) any unplugging of either of the two conductor cables 182, 184 interupts the center conductors circuit and causes the alarm means to signal that a theft is underway; (3) any attempt to cut the two conductor cables 182, 184 causes a shorting of ground sheath 196 to center conductor 208, as an example, and causes the alarm means to signal that a theft is underway. Through the use of these features, even if a merchandise theft deterrent sensor 2 is removed from hard goods 1, all remaining merchandise theft deterrent sensors continue to function for other hard goods on display. Because the membrane switch assembly 144 only activates during a pushing or pulling force such as would occur with an attempted theft, the merchandise theft deterrent sensor and its alarm system remains totally passive. Following removal of the membrane sensor from the merchandise, the membrane rebounds to its original electrical state. With a suitable alarm means the merchandise theft deterrent sensor 2 concept operates with all the advantages of a parallel circuit without unnecessary duplication electrical conductor chatter, and, at the same time enabling the user to expand or contract the number of items being protected by the merchandise theft deterrent sensor.

I have found that the use of a membrane switch assembly 144 of total thickness of about 0.025 inches with an activation movement of about 0.002 to 0.003 inches provides a suitable selection to effect operation of the merchandise theft deterrent sensor, and I have found that a merchandise theft deterrent sensor with dimensions of 1"×2"×0.360" provides an adequate sizing to prevent tamper removal with setting off a suitable alarm means when the merchandise theft deterrent switch 2 is moved. I have further found that by manufacturing the lid 4 with a thickness of 0.100 inches the merchandise theft deterrent sensor can be checked by lid 4 depression of about 0.004 inches while the merchandise theft deterrent sensor 2 is in place on hard good 1, I have further found that adhesive thickness of 0.040 inches provide a suitable working thickness. I have found that specially designed two conductor cables 182, 184, as described, to satisfactorily complete the electrical requirements of the merchandise theft deterrent sensor.

In accordance with the specification as my invention, I claim:

1. A theft detection system, comprising:

a. an alarm means;

b. a deformable membrane switch sensor, including:

i. a first membrane providing conducting networks on both sides thereof;

ii. a second membrane disposed adjacent the first membrane and providing an electrical shielding network therefor;

iii. a third membrane disposed between and insulating the first and second membranes;

iv. electrical leads connecting the conducting networks and the shielding network with the alarm means;

the membranes being adapted on deformation to effect contact between the conducting networks to produce a signal from the sensor to the alarm means;

c. a moveable piston assembly in close proximity to the membrane switch, and radially spaced from the electrical networks, the piston being adhesively secured to an article of merchandise, and:

i. on an initial slight movement, to temporarily deform the membrane switch and produce a test signal from the sensor when the alarm means is in a test mode;

ii. upon termination of the initial movement, to rebound to its initial state and terminate the test signal; and iii. to deform the membrane switch and produce a theft alarm when actuated by a theft movement when the alarm means is active;

d. container means for the membrane switch sensor and the moveable piston, the container being adhesively secured to an article of merchandise, a cavity being defined within the container means, of the cavity, and the piston at one end thereof is in close proximity to an opposing surface of the cavity;

whereby, separation of the merchandise from the container means will move the piston, deform the membranes and produce a theft alarm, and following removal of the container from the merchandise, the sensor, including the piston and membrane switch will rebound to the original electrical state of the sensor.

2. The theft detection system of claim 1, in which the adhesive securing the piston within the container to the merchandise surface is an elastic material, thereby enabling movement of the piston to deform the membrane, and produce a test alarm in the system.

3. The theft detection system of claim 1, in which the conducting and shielding networks are photoscreened onto their respective sides of the membranes.

4. The detection system of claim 1, in which the membrane switch defines a central aperture, and the piston is positioned within the aperture and is radially spaced therefrom, the piston providing a medial flange adapted to deform at least one membrane of the said switch.

5. The detection system of claim 4, in which the piston provides a lower flange adhesively secured to the merchandise, and the membrane switch is disposed between the medial and lower flanges.

6. The detection system of claim 1, in which movement of the membrane switch for producing a theft alarm is about 0.002 to about 0.003 inches.

7. The membrane switch of claim 1, in which the membranes comprise plastic film.

8. A switch sensor, comprising:

a. a deformable membrane switch sensor, including:

i. a first membrane providing conducting electrical networks on both sides with an electrical shielding network on one side thereof;

ii. a second membrane disposed adjacent the first membrane with an electrical conducting network therefore;

iii. a third membrane disposed between and insulating the first and second membranes; and iv. electrical leads connecting the conducting networks and the shielding network with an alarm means, the membranes being adapted on deformation to effect contact between the conducting and shielding networks and produce a signal from the sensor to the alarm means, b. a moveable piston assembly in close proximity to the membrane switch, and radially spaced from the electrical networks, the piston being adhesively secured to an article of merchandise, the piston being adapted:

i. on an initial slight movement, to temporarily deform the membrane switch and produce a test signal from the sensor when the alarm means is in a test mode;

ii. upon termination of the initial movement, to rebound to its initial state and terminate the test signal; and iii. to deform the membrane switch and produce a theft alarm when actuated by a theft movement when the alarm means is active;

c. container means for the membrane switch sensor and piston, the container being adhesively secured to the article of merchandise, a cavity being defined within the container means, the membrane switch being adhesively secured to an interior surface of the cavity, and the piston at one end thereof is in close proximity to an opposing surface of the cavity;

whereby, separation of the merchandise from the container means will move the piston, deform the membranes and produce a theft alarm, and following removal of the container from the merchandise, the sensor, including the piston and membrane switch will rebound to the original electrical state of the sensor.

9. The switch sensor of claim 8, in which the adhesive securing the piston to the container means is an elastic material, thereby enabling movement of the piston to deform the membrane, and produce a test alarm in the system.

10. The switch sensor of claim 9, in which the conducting and shielding networks are photoscreened onto their respective sides of the membrane.

11. The switch sensor of claim 10, in which the membrane switch defines a central aperture, and the piston is positioned within the aperture and is radially spaced therefrom, the piston providing a medial flange adapated to deform the least one membrane of the said switch.

12. The switch sensor of claim 11, in which the piston provides a lower flange adhesively secured to the merchandise, and the membrane switch is disposed between the medial and lower flanges.

13. The switch sensor of claim 12, in which movement of the membrane switch for producing a theft alarm is about 0.002 to 0.003 inches.

14. The switch sensor of claim 13, in which the membranes comprise plastic film.

* * * * *